US009587855B2

(12) United States Patent
Tsai

(10) Patent No.: US 9,587,855 B2
(45) Date of Patent: Mar. 7, 2017

(54) METHOD FOR OPERATING A WATER HEATER APPLIANCE

(71) Applicant: General Electric Company, Schenectady, NY (US)

(72) Inventor: Craig Iung-Pei Tsai, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 357 days.

(21) Appl. No.: 14/295,800

(22) Filed: Jun. 4, 2014

(65) Prior Publication Data

US 2015/0354855 A1 Dec. 10, 2015

(51) Int. Cl.

| | |
|---|---|
| ***F24H 9/20*** | (2006.01) |
| ***G06F 17/10*** | (2006.01) |
| ***G05B 15/02*** | (2006.01) |

(52) U.S. Cl.

CPC ..... *F24H 9/2021* (2013.01)

(58) Field of Classification Search

CPC ..... F24H 9/2021; F24H 9/20; F24H 9/2007
See application file for complete search history.

(56) References Cited

U.S. PATENT DOCUMENTS 5,968,393 A * 10/1999 Demaline ..... G05D 23/1904 219/485
7,798,107 B2 * 9/2010 Chian ..... F24H 9/2021 122/14.22
7,818,095 B2 * 10/2010 Hotton ..... F24H 1/202 122/14.1
7,930,937 B2 * 4/2011 Roques ..... G01F 23/22 73/295
8,407,015 B2 * 3/2013 Yatir ..... F24H 9/0021 374/102
8,530,799 B2 9/2013 Ding et al.
2007/0175883 A1 * 8/2007 Miu ..... F24H 9/2021 219/400
2011/0211612 A1 * 9/2011 Branecky ..... F24D 19/1006 374/115
2013/0173205 A1 * 7/2013 Van Houten ..... G01K 3/06 702/136
2013/0193221 A1 * 8/2013 Buescher ..... F24H 9/2021 237/8 A

FOREIGN PATENT DOCUMENTS

JP 6468213 A 3/1989

OTHER PUBLICATIONS

Legionella and the prevention of legionellosis, World Health Organization, 2007. ISBN 92 4 156297 8.*

* cited by examiner

*Primary Examiner* — Mohammad Ali
*Assistant Examiner* — Joshua Sanders
(74) *Attorney, Agent, or Firm* — Dority & Manning, P.A.

(57) ABSTRACT

A method for operating a water heater appliance is provided. The method includes establishing a temperature drop of water within a tank of the water heater appliance during a time interval. A volume of heated water within the tank is estimated based at least in part on the temperature drop of water within the tank of the water heater appliance during the time interval and a set temperature of the water heater appliance. A related water heater appliance is also provided.

16 Claims, 5 Drawing Sheets

METHOD FOR OPERATING A WATER HEATER APPLIANCE

FIELD OF THE INVENTION

The present subject matter relates generally to water heater appliances and methods for operating the same. More particularly, the present subject matter relates to methods for establishing a volume of heated water within a tank of a water heater appliance.

BACKGROUND OF THE INVENTION

Water heater appliances generally operate to heat water within tanks of the water heater appliances to a predetermined set temperature. During water draw events, heated water is drawn from the tanks for use, and the heated water is replaced with relatively cool water. Thus, a volume of heated water within water heater appliances can vary over time. Accurately determining or measuring the volume of heated water within the tank of a water heater appliance can be difficult.

Certain water heater appliances utilize multiple temperature sensors positioned along a height of the tank to determine the volume of heated water within the tank. The temperatures sensors measure the temperature of water with the tank at various heights, and the volume of heated water within the tank is determined from the temperature measurements. Other water heater appliances utilize flow meters to determine the volume of heated water within the tank. Utilizing multiple temperature sensors or flow meters to determine the volume of heated water in the tank has certain drawbacks. In particular, providing multiple temperature sensors or flow meters can be expensive.

Accordingly, methods for measuring or determining a volume of heated water within a tank of a water heater appliance would be useful. In particular, methods for measuring or determining a volume of heated water within a tank of a water heater appliance that do not require or use multiple temperature sensors would be useful.

BRIEF DESCRIPTION OF THE INVENTION

The present subject matter provides a method for operating a water heater appliance. The method includes establishing a temperature drop of water within a tank of the water heater appliance during a time interval. A volume of heated water within the tank is estimated based at least in part on the temperature drop of water within the tank of the water heater appliance during the time interval and a set temperature of the water heater appliance. A related water heater appliance is also provided. Additional aspects and advantages of the invention will be set forth in part in the following description, or may be apparent from the description, or may be learned through practice of the invention.

In a first exemplary embodiment, a method for operating a water heater appliance is provided. The method includes measuring a temperature of water within a tank of the water heater appliance at a first time during a time interval, gauging the temperature of water within the tank of the water heater appliance at a second time during the time interval, establishing a temperature drop of water within the tank of the water heater appliance during the time interval and estimating a volume of heated water within the tank based at least in part on the temperature drop of water within the tank of the water heater appliance from the step of establishing and a set temperature, ts, of the water heater appliance.

In a second exemplary embodiment, a water heater appliance is provided. The water heater appliance includes a tank that defines an interior volume and means for heating water within the interior volume of the tank to a set temperature, ts. A temperature sensor is positioned adjacent a top portion of the tank and is configured for measuring a temperature of water within the interior volume of the tank. A controller is in communication with the temperature sensor. The controller is configured for measuring the temperature of water within interior volume of the tank with the temperature sensor at a first time during a time interval, gauging the temperature of water within interior volume of the tank with the temperature sensor at a second time during the time interval, establishing a temperature drop of water within the interior volume of the tank during the time interval and estimating a volume of heated water within the interior volume of the tank based at least in part on the temperature drop of water within the tank from the step of establishing and the set temperature, ts.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
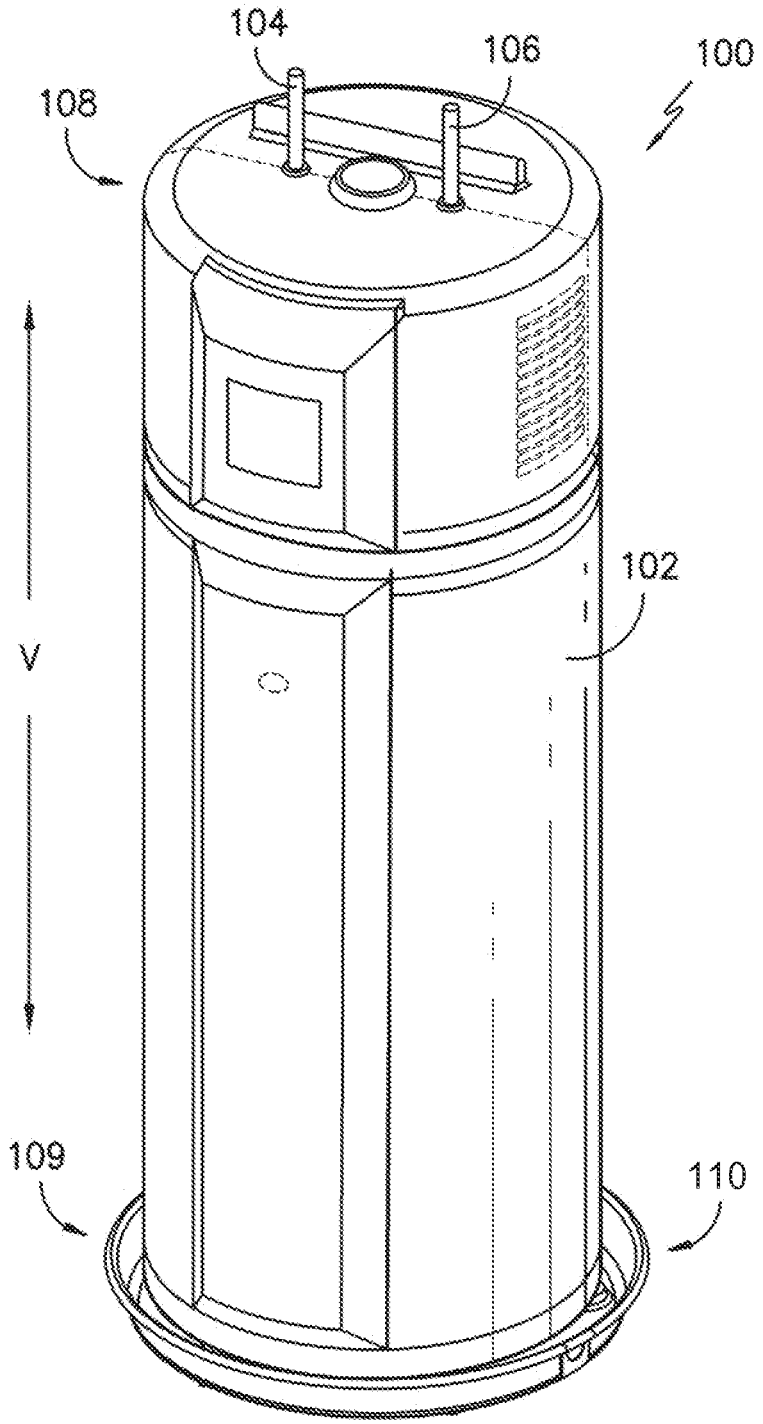
FIG. 1 provides a perspective view of a water heater appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
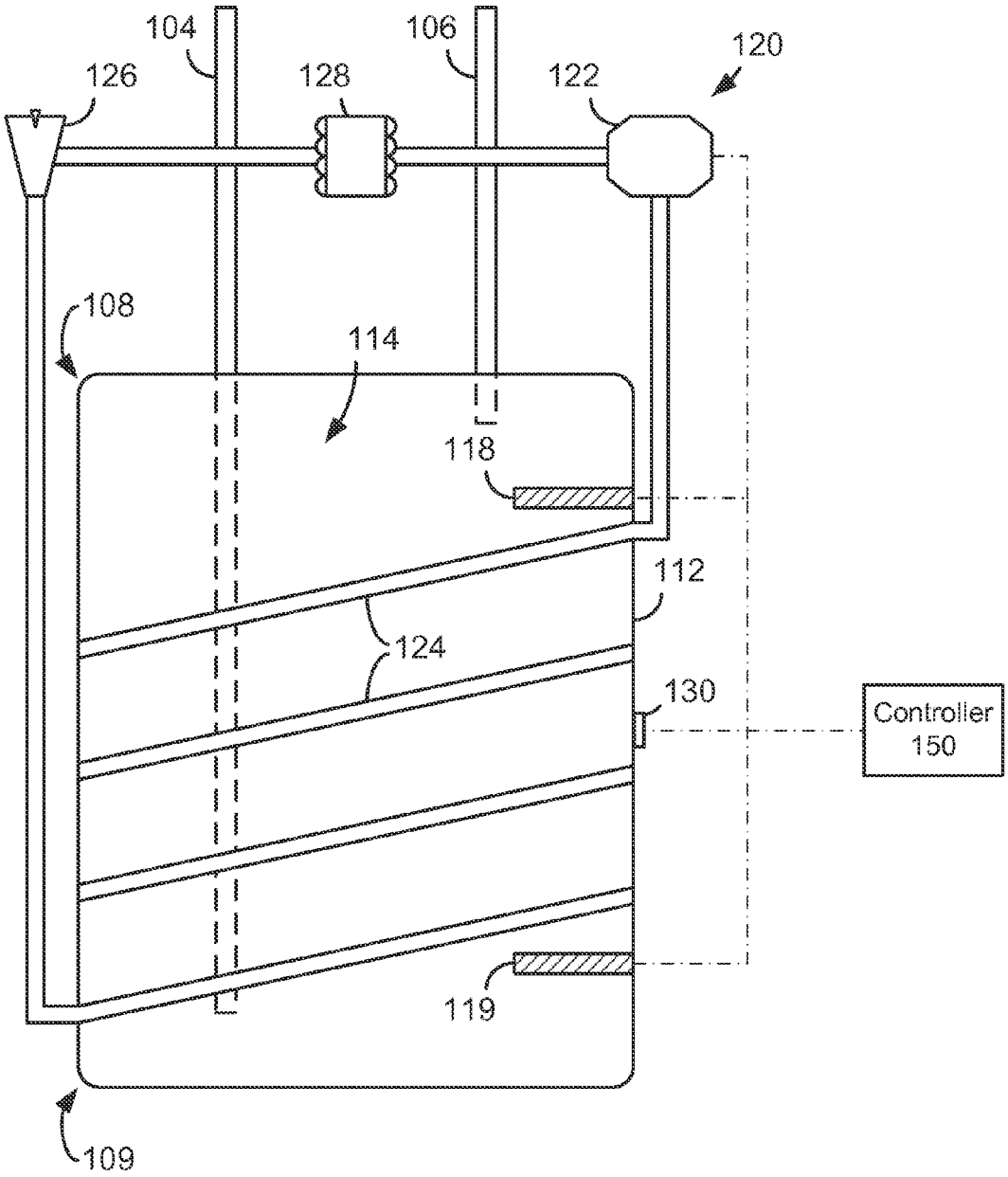
FIG. 2 provides a schematic view of certain components of the exemplary water heater appliance of FIG. 1.

FIG. 1 provides a perspective view of a water heater appliance 100 according to an exemplary embodiment of the present subject matter. FIG. 2 provides a schematic view of certain components of water heater appliance 100. Water heater appliance 100 includes a casing 102. A tank 112 (FIG. 2) is mounted within casing 102. Tank 112 defines an interior volume 114 for heating water therein.

Water heater appliance 100 also includes a cold water conduit 104 and a hot water conduit 106 that are both in fluid communication with tank 112 within casing 102. As an example, cold water from a water source, e.g., a municipal water supply or a well, enters water heater appliance 100 through cold water conduit 104. From cold water conduit 104, such cold water enters interior volume 114 of tank 112 wherein the water is heated to generate heated water. Such heated water exits water heater appliance 100 at hot water conduit 106 and, e.g., is supplied to a bath, shower, sink, or any other suitable feature.

As may be seen in FIG. 1, water heater appliance 100 extends between a top portion 108 and a bottom portion 109 along a vertical direction V. Thus, water heater appliance 100 is generally vertically oriented. Water heater appliance 100 can be leveled, e.g., such that casing 102 is plumb in the vertical direction V, in order to facilitate proper operation of water heater appliance 100.

A drain pan 110 is positioned at bottom portion 109 of water heater appliance 100 such that water heater appliance 100 sits on drain pan 110. Drain pan 110 sits beneath water heater appliance 100 along the vertical direction V, e.g., to collect water that leaks from water heater appliance 100 or water that condenses on an evaporator 128 of water heater appliance 100. It should be understood that water heater appliance 100 is provided by way of example only and that the present subject matter may be used with any suitable water heater appliance.

Turning now to FIG. 2, water heater appliance 100 includes an upper heating element 118 and a lower heating element 119 and a sealed system 120 for heating water within interior volume 114 of tank 112. Thus, water heater appliance 100 is commonly referred to as a "heat pump water heater appliance." Upper and lower heating elements 118 and 119 can be any suitable heating elements. For example, upper heating element 118 and/or lower heating element 119 may be an electric resistance element, a microwave element, an induction element, or any other suitable heating element or combination thereof. Lower heating element 119 may also be a gas burner.

Sealed system 120 includes a compressor 122, a condenser 124, a throttling device 126 and an evaporator 128. Condenser 124 is thermally coupled or assembled in a heat exchange relationship with tank 112 in order to heat water within interior volume 114 of tank 112 during operation of sealed system 120. In particular, condenser 124 may be a conduit coiled around and mounted to tank 112. During operation of sealed system 120, refrigerant exits evaporator 128 as a fluid in the form of a superheated vapor and/or high quality vapor mixture. Upon exiting evaporator 128, the refrigerant enters compressor 122 wherein the pressure and temperature of the refrigerant are increased such that the refrigerant becomes a superheated vapor. The superheated vapor from compressor 122 enters condenser 124 wherein it transfers energy to the water within tank 112 and condenses into a saturated liquid and/or high quality liquid vapor mixture. This high quality/saturated liquid vapor mixture exits condenser 124 and travels through throttling device 126 that is configured for regulating a flow rate of refrigerant therethrough. Upon exiting throttling device 126, the pressure and temperature of the refrigerant drop at which time the refrigerant enters evaporator 128 and the cycle repeats itself. In certain exemplary embodiments, throttling device 126 may be an electronic expansion valve (EEV).

Water heater appliance 100 also includes a tank temperature sensor 130. Tank temperature sensor 130 is configured for measuring a temperature of water within interior volume 114 of tank 112. Tank temperature sensor 130 can be positioned at any suitable location within or on water heater appliance 100. For example, tank temperature sensor 130 may be positioned within interior volume 114 of tank 112 or may be mounted to tank 112 outside of interior volume 114 of tank 112. When mounted to tank 112 outside of interior volume 114 of tank 112, tank temperature sensor 130 can be configured for indirectly measuring the temperature of water within interior volume 114 of tank 112. For example, tank temperature sensor 130 can measure the temperature of tank 112 and correlate the temperature of tank 112 to the temperature of water within interior volume 114 of tank 112. Tank temperature sensor 130 may also be positioned at or adjacent top portion 108 of water heater appliance 100, e.g., at or adjacent an inlet of hot water conduit 106. Tank temperature sensor 130 can be any suitable temperature sensor. For example, tank temperature sensor 130 may be a thermocouple or a thermistor.

Water heater appliance 100 further includes a controller 150 that is configured for regulating operation of water heater appliance 100. Controller 150 is in, e.g., operative, communication with upper and lower heating elements 118 and 119, compressor 122 and tank temperature sensor 130. Thus, controller 150 may selectively activate upper and lower heating elements 118 and 119 and/or compressor 122 in order to heat water within interior volume 114 of tank 112.

Controller 150 includes memory and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 150 may operate upper heating element 118, lower heating element 119 and/or compressor 122 in order to heat water within interior volume 114 of tank 112. As an example, a user may select or establish a set temperature, $t_s$, for water within interior volume 114 of tank 112, or the set temperature $t_s$ for water within interior volume 114 of tank 112 may be a default value. Based upon the set temperature $t_s$ for water within interior volume 114 of tank 112, controller 150 may selectively activate upper heating element 118, lower heating element 119 and/or compressor 122 in order to heat water within interior volume 114 of tank 112 to the set temperature $t_s$ for water within interior volume 114 of tank 112. The set temperature $t_s$ for water within interior volume 114 of tank 112 may be any suitable temperature. For example, the set temperature $t_s$ for water within interior volume 114 of tank 112 may be between about one hundred degrees Fahrenheit and about one hundred and eighty-degrees Fahrenheit.

Figure 3:
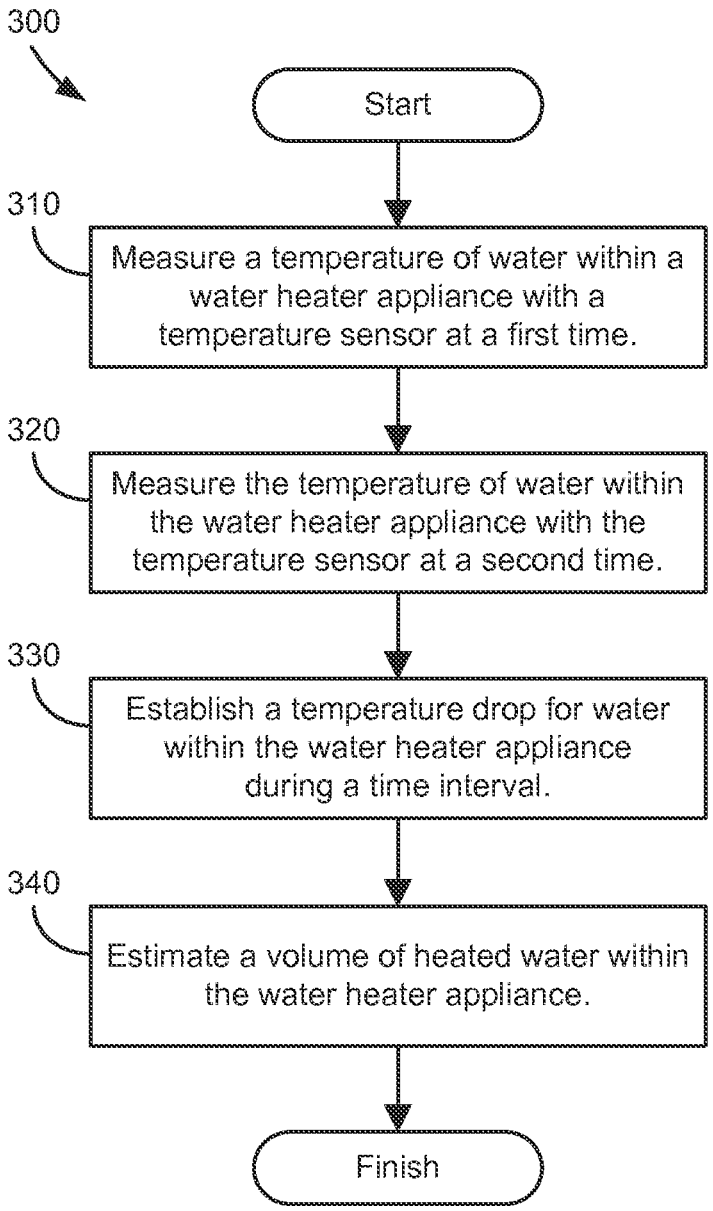
FIG. 3 illustrates a method for operating a water heater appliance according to an exemplary embodiment of the present subject matter.

FIG. 3 illustrates a method 300 for operating a water heater appliance according to an exemplary embodiment of the present subject matter. Method 300 can be used to operate any suitable water heater appliance. For example, method 300 may be used to operate water heater appliance 100 (FIG. 1). Controller 150 may be programmed or configured to implement method 300. Utilizing method 300, a volume of heated water within interior volume 114 of tank 112 may be established or determined, e.g., based at least in part on temperature measurements from tank temperature sensor 130 and the set temperature $t_s$ for water within interior volume 114 of tank 112, as discussed in greater detail below.

At step 310, a temperature of water within tank 112 of water heater appliance 100 is measured at a first time during a time interval. As an example, controller 150 may measure or gauge the temperature of water within tank 112 of water heater appliance 100 at the first time with tank temperature sensor 130 at step 310. The first time may be any suitable time during the time interval. For example, the first time may be at a beginning of the time interval.

At step 320, the temperature of water within tank 112 of water heater appliance 100 is gauged at a second time during the time interval. As an example, controller 150 may measure or gauge the temperature of water within tank 112 of water heater appliance 100 at the second time with tank temperature sensor 130 at step 320. The second time may be any suitable time during the time interval. For example, the second time may be at an end of the time interval. The time interval may be any suitable time interval. For example, the time interval may be about an hour.

At step 330, a temperature drop of water within tank 112 of water heater appliance 100 during the time interval is established. As an example, controller 150 may calculate a difference between the temperature of water within tank 112 of water heater appliance 100 at the first time from step 310 and the temperature of water within tank 112 of water heater appliance 100 at the second time from step 320 in order to establish the temperature drop of water within tank 112 of water heater appliance 100 during the time interval at step 330. Thus, the temperature drop of water within tank 112 of water heater appliance 100 during the time interval may correspond to a decrease in the temperature of water within tank 112 of water heater appliance 100 between the first and second times of the time interval.

At step 340, a volume of heated water within tank 112 is estimated. In particular, the volume of heated water within tank 112 may be estimated based at least in part on the temperature drop of water within tank 112 of water heater appliance 100 from step 330 and the set temperature $t_s$ for water within interior volume 114 of tank 112. Step 340 is discussed in greater detail below with reference to FIGS. 4 and 5.

Figure 4:
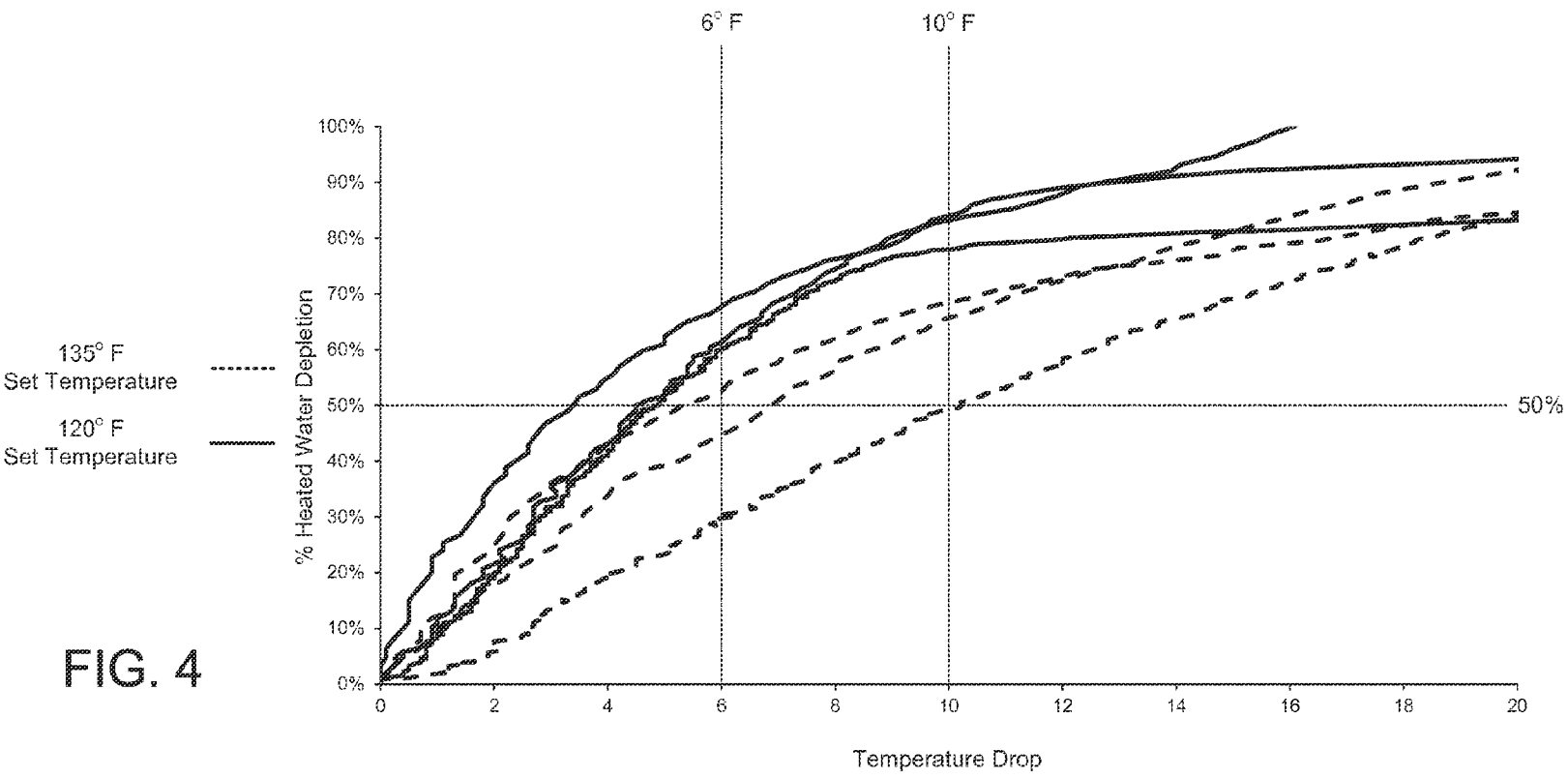
FIGS. 4 and 5 provide plots of a temperature drop within a water heater appliance versus a percentage of heated water within the water heater appliance.
Figure 5:
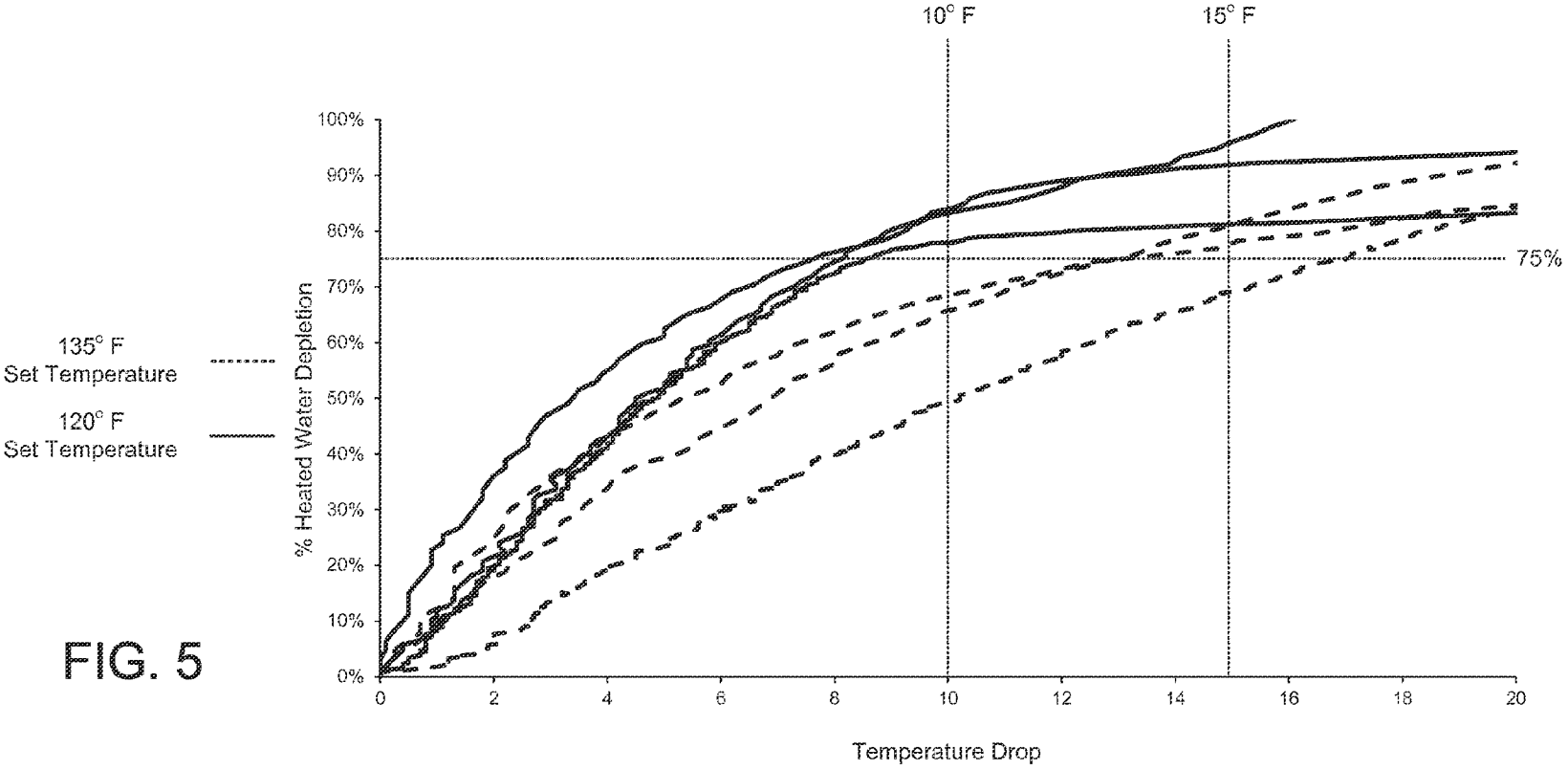

FIG. 4 and FIG. 5 provide plots of a temperature drop within tank 112 of water heater appliance 100 versus a percentage of heated water within tank 112 of water heater appliance 100. Thus, in FIGS. 4 and 5, a correlation between the temperature drop of water within tank 112 of water heater appliance 100 during the time interval and the volume of heated water within tank 112 is illustrated. As discussed above, method 300 may utilize the temperature drop of water within tank 112 of water heater appliance 100 from step 330 and the set temperature $t_s$ for water within interior volume 114 of tank 112 to estimate the volume of heated water within interior volume 114 of tank 112.

Method 300 may estimate that about fifty percent of the heated water within tank 112 has been depleted when the temperature drop of water within tank 112 of water heater appliance 100 from step 330 is greater than (or equal to) a first function of the set temperature $t_s$ for water within interior volume 114 of tank 112, e.g., when the set temperature $t_s$ for water within interior volume 114 of tank 112 is greater than (or equal to) one hundred and twenty degrees Fahrenheit. The first function of the set temperature $t_s$ for water within interior volume 114 of tank 112 may be any suitable function. In certain exemplary embodiments, the first function of the set temperature $t_s$ for water within interior volume 114 of tank 112 may be determined empirically. For example, when water heater appliance 100 is a fifty gallon water heater appliance, the first function of the set temperature $t_s$ for water within interior volume 114 of tank 112 may be the following:

$$F_1(t_s) = 6 + \frac{4}{15}(t_s - 120) \text{ or } F_1(t_s) = 7 + \frac{1}{3}(t_s - 120).$$

Thus, method 300 may estimate that about fifty percent of the heated water within tank 112 has been depleted when the temperature drop of water within tank 112 of water heater appliance 100 from step 330 is six degrees Fahrenheit and the set temperature $t_s$ for water within interior volume 114 of tank 112 is one hundred and twenty degrees Fahrenheit. Conversely, method 300 may estimate that about fifty percent of the heated water within tank 112 has been depleted when the temperature drop of water within tank 112 of water heater appliance 100 from step 330 is ten degrees Fahrenheit and the set temperature $t_s$ for water within interior volume 114 of tank 112 is one hundred and thirty-five degrees Fahrenheit. As may be seen in FIG. 4, an error range of method 300 is between about negative two percent and about eighteen percent for the experimental values of FIG. 4. In such a manner, method 300 may utilize measurements from tank temperature sensor 130 and the set temperature $t_s$ for water within interior volume 114 of tank 112 to estimate the volume of heated water within tank 112.

As another example, when water heater appliance 100 is an eighty gallon water heater appliance, the first function of the set temperature $t_s$ for water within interior volume 114 of tank 112 may be the following:

$$F_1(t_s) = 3 + \frac{1}{15}(t_s - 120).$$

Thus, method 300 may estimate that about fifty percent of the heated water within tank 112 has been depleted when the temperature drop of water within tank 112 of water heater appliance 100 from step 330 is three degrees Fahrenheit and the set temperature $t_s$ for water within interior volume 114 of tank 112 is one hundred and twenty degrees Fahrenheit. Conversely, method 300 may estimate that about fifty percent of the heated water within tank 112 has been depleted when the temperature drop of water within tank 112 of water heater appliance 100 from step 330 is four degrees Fahrenheit and the set temperature $t_s$ for water within interior volume 114 of tank 112 is one hundred and thirty-five degrees Fahrenheit.

It should be understood that the constants given in the functions above may vary depending upon the size and particular arrangement of water heater appliance 100. For example, the constants provided above for the first function of the set temperature $t_s$ may be increased or decreased by about one percent, by about five percent or by about ten percent in alternative exemplary embodiments.

Method 300 may estimate that about seventy-five percent of the heated water within tank 112 has been depleted when the temperature drop of water within tank 112 of water heater appliance 100 from step 330 is greater than (or equal to) a second function of the set temperature $t_s$ for water within interior volume 114 of tank 112, e.g., when the set temperature $t_s$ for water within interior volume 114 of tank 112 is greater than (or equal to) one hundred and twenty degrees Fahrenheit. The second function of the set temperature $t_s$ for water within interior volume 114 of tank 112 may be any suitable function. In certain exemplary embodiments, the second function of the set temperature $t_s$ for water within interior volume 114 of tank 112 may be determined empirically. For example, when water heater appliance 100 is a fifty gallon water heater appliance, the second function of the set temperature $t_s$ for water within interior volume 114 of tank 112 may be the following:

$$F_2(t_s) = 10 + \frac{1}{3}(t_s - 120).$$

Thus, method 300 may estimate that about seventy-five percent of the heated water within tank 112 has been depleted when the temperature drop of water within tank 112 of water heater appliance 100 from step 330 is ten degrees Fahrenheit and the set temperature $t_s$ for water within interior volume 114 of tank 112 is one hundred and twenty degrees Fahrenheit. Conversely, method 300 may estimate that about seventy-five percent of the heated water within tank 112 has been depleted when the temperature drop of water within tank 112 of water heater appliance 100 from step 330 is fifteen degrees Fahrenheit and the set temperature $t_s$ for water within interior volume 114 of tank 112 is one hundred and thirty-five degrees Fahrenheit. As may be seen in FIG. 5, an error range of method 300 is between about negative five percent and about ten percent for the experimental values of FIG. 5. In such a manner, method 300 may utilize measurements from tank temperature sensor 130 and the set temperature $t_s$ for water within interior volume 114 of tank 112 to estimate the volume of heated water within tank 112.

As another example, when water heater appliance 100 is an eighty gallon water heater appliance, the second function of the set temperature $t_s$ for water within interior volume 114 of tank 112 may be the following:

$$F_2(t_s) = 3 + \frac{1}{15}(t_s - 120).$$

Thus, method 300 may estimate that about seventy-five percent of the heated water within tank 112 has been depleted when the temperature drop of water within tank 112 of water heater appliance 100 from step 330 is three degrees Fahrenheit and the set temperature $t_s$ for water within interior volume 114 of tank 112 is one hundred and twenty degrees Fahrenheit. Conversely, method 300 may estimate that about seventy-five percent of the heated water within tank 112 has been depleted when the temperature drop of water within tank 112 of water heater appliance 100 from step 330 is four degrees Fahrenheit and the set temperature $t_s$ for water within interior volume 114 of tank 112 is one hundred and thirty-five degrees Fahrenheit.

It should be understood that the constants given in the functions above may vary depending upon the size and particular arrangement of water heater appliance 100. For example, the constants provided above for the second function of the set temperature $t_s$ may be increased or decreased by about one percent, by about five percent or by about ten percent in alternative exemplary embodiments.

It should be understood that while described in the context of water heater appliance 100, method 300 may be used in any suitable water heater appliance. For example, method 300 may be used in or with electric water heater appliances, gas water heater appliances, etc. Thus, method 300 is not limited to use in or with heat pump water heater appliances.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a water heater appliance comprising a tank and a heating element to heat water within the tank, the method comprising:

measuring a temperature of water within the tank of the water heater appliance at a first time during a time interval;

measuring the temperature of water within the tank of the water heater appliance at a second time during the time interval;

establishing a temperature drop of water within the tank of the water heater appliance during the time interval, the step of establishing a temperature drop comprising calculating a difference between the temperature of water within the tank of the water heater appliance at the first time and the temperature of water within the tank of the water heater appliance at the second time, and comparing the difference in temperatures to one or more functions of a set temperature, $t_s$, the set temperature $t_s$ of the water heater appliance being greater than one hundred and twenty degrees Fahrenheit;

estimating that the volume of heated water within the tank is half a volume of the tank if the temperature drop of water within the tank of the water heater appliance from said step of establishing is greater than a first function of the set temperature $t_s$ of the water heater appliance, and estimating that the volume of heated water within the tank is one-quarter of the volume of the tank if the temperature drop of water within the tank of the water heater appliance from said step of establishing is greater than a second function of the set temperature $t_s$ of the water heater appliance; and activating the heating element to heat water within the tank based on the estimated volume of heated water.

2. The method of claim 1, wherein said step of measuring comprises measuring the temperature of water within the tank of the water heater appliance with a temperature sensor of the water heater appliance, wherein said step of gauging comprises gauging the temperature of water within the tank of the water heater appliance with the temperature sensor of the water heater appliance.

3. The method of claim 1, wherein a temperature sensor of the water heater appliance is positioned at a top portion of the tank of the water heater appliance.

4. The method of claim 1, wherein the first function of the set temperature it of the water heater appliance comprises $$F_1(t_s) = 6 + \frac{4}{15}(t_s - 120) \text{ or } F_1(t_s) = 7 + \frac{1}{3}(t_s - 120).$$

5. The method of claim 4, wherein the second function of the set temperature $t_s$ of the water heater appliance comprises $$F_2(t_s) = 10 + \frac{1}{3}(t_s - 120).$$

6. The method of claim 1, wherein the first function of the set temperature $t_s$ of the water heater appliance comprises $$F_1(t_s) = 3 + \frac{1}{15}(t_s - 120).$$

7. The method of claim 4, wherein the second function of the set temperature $t_s$ of the water heater appliance comprises $$F_2(t_s) = 10 + \frac{7}{15}(t_s - 120).$$

8. The method of claim 1, wherein the time interval is an hour.

9. A water heater appliance, comprising:

a tank defining an interior volume;

means for heating water within the interior volume of the tank to a set temperature, $t_s$;

a temperature sensor positioned adjacent a top portion of the tank and configured for measuring a temperature of water within the interior volume of the tank;

a controller in communication with the temperature sensor and the means for heating water, the controller configured for measuring the temperature of water within interior volume of the tank with the temperature sensor at a first time during a time interval;

measuring the temperature of water within interior volume of the tank with the temperature sensor at a second time during the time interval;

establishing a temperature drop of water within the interior volume of the tank during the time interval, the step of establishing a temperature drop comprising calculating a difference between the temperature of water within the tank of the water heater appliance at the first time and the temperature of water within the tank of the water heater appliance at the second time, and comparing the difference in temperatures to one or more functions of a set temperature, $t_s$, the set temperature $t_s$ of the water heater appliance being greater than one hundred and twenty degrees Fahrenheit;

estimating that the volume of heated water within the tank is half a volume of the tank if the temperature drop of water within the tank of the water heater appliance from said step of establishing is greater than a first function of the set temperature $t_s$ of the water heater appliance, and estimating that the volume of heated water within the tank is one-quarter of the volume of the tank if the temperature drop of water within the tank of the water heater appliance from said step of establishing is greater than a second function of the set temperature $t_s$ of the water heater appliance; and activating the means for heating water based on the estimated volume of heated water.

10. The water heater appliance of claim 9, wherein the temperature sensor is mounted to the tank at a top portion of the tank.

11. The water heater appliance of claim 9, wherein said step of establishing comprises calculating a difference between the temperature of water within the tank of the water heater appliance at the first time and the temperature of water within the tank of the water heater appliance at the second time.

12. The water heater appliance of claim 9, wherein the first function of the set temperature $t_s$ comprises $$F_1(t_s) = 6 + \frac{4}{15}(t_s - 120) \text{ or } F_1(t_s) = 7 + \frac{1}{3}(t_s - 120).$$

13. The water heater appliance of claim 9, wherein the second function of the set temperature $t_s$ comprises $$F_2(t_s) = 10 + \frac{1}{3}(t_s - 120).$$

14. The water heater appliance of claim 9, wherein the first function of the set temperature $t_s$ comprises $$F_1(t_s) = 3 + \frac{1}{15}(t_s - 120).$$

15. The water heater appliance of claim 9, wherein the second function of the set temperature $t_s$ comprises $$F_2(t_s) = 10 + \frac{7}{15}(t_s - 120).$$

16. The water heater appliance of claim 9, wherein the time interval is about an hour.

* * * * *